US007266333B2

(12) United States Patent
Hara

(10) Patent No.: US 7,266,333 B2
(45) Date of Patent: Sep. 4, 2007

(54) SEMICONDUCTIVE BELT AND IMAGE FORMING APPARATUS USING THE SEMICONDUCTIVE BELT

(75) Inventor: Yukio Hara, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 134 days.

(21) Appl. No.: 11/293,323

(22) Filed: Dec. 5, 2005

(65) Prior Publication Data

US 2006/0239726 A1 Oct. 26, 2006

(30) Foreign Application Priority Data

Apr. 20, 2005 (JP) ..... 2005-122273

(51) Int. Cl.
*G03G 15/16* (2006.01)

(52) U.S. Cl. ..... 399/302; 399/303

(58) Field of Classification Search ..... 399/302, 399/303

See application file for complete search history.

(56) References Cited

U.S. PATENT DOCUMENTS

2005/0170274 A1* 8/2005 Matsumura et al. ..... 430/126
2005/0249527 A1* 11/2005 Kuramoto ..... 399/302

FOREIGN PATENT DOCUMENTS

| | | |
|---|---|---|
| JP | A 62-206567 | 9/1987 |
| JP | A 05-077252 | 3/1993 |
| JP | A 05-200904 | 8/1993 |
| JP | A 06-095521 | 4/1994 |
| JP | A 06-149079 | 5/1994 |
| JP | A 06-149081 | 5/1994 |
| JP | A 06-149083 | 5/1994 |
| JP | A 06-228335 | 8/1994 |
| JP | A 09-305038 | 11/1997 |
| JP | A 10-063115 | 3/1998 |
| JP | A 10-240020 | 9/1998 |
| JP | A 11-024428 | 1/1999 |
| JP | A 11-045015 | 2/1999 |
| JP | A 2001-282009 | 10/2001 |

* cited by examiner

*Primary Examiner*—Quana Grainger
(74) *Attorney, Agent, or Firm*—Oliff & Berridge, PLC

(57) ABSTRACT

The present invention provides a semiconductive belt including a substrate and a surface layer, wherein: the substrate contains a resin; the Young's modulus of the substrate is 1000 to 8000 MPa; the surface layer contains a lubricant component, a fibrous filling material, and an elastic material; and the durometer hardness of the surface layer is A30/S to A70/S.

14 Claims, 4 Drawing Sheets

SEMICONDUCTIVE BELT AND IMAGE FORMING APPARATUS USING THE SEMICONDUCTIVE BELT

CROSS-REFERENCE TO RELATED APPLICATION

This application claims priority under 35 USC 119 from Japanese Patent Application No. 2005-122273, the disclosure of which is incorporated by reference herein.

BACKGROUND OF THE INVENTION

1. Field of the Invention

The present invention relates to a semiconductive belt which can be used in an image forming apparatus using an electrophotographic system such as a copy machine and a printer, and relates to an image forming apparatus using the semiconductive belt.

2. Description of the Related Art

In an image forming apparatus using an electrophotographic system, first, a uniform electric charge is made on an image carrier surface of a photoconductive photoreceptor made of inorganic or organic materials, and an electrostatic latent image is formed by a laser or the like modulating an image signal, and the electrostatic latent image is developed by a charged toner, and a visualized toner image is formed. The toner image is electrostatically transferred on a transfer material such as recording paper either directly or through an intermediate transfer medium, and is fixed, and a desired image is obtained.

In particular, an image forming apparatus transferring in two steps is known, in which a toner image formed on an image carrier is transferred primarily on an intermediate transfer medium, and the toner image on the intermediate transfer medium is transferred secondarily on a recording paper (see, for example, Japanese Patent Application Laid-Open (JP-A) No. 62-206567).

In the image forming apparatus employing the intermediate transfer medium system, the intermediate transfer medium is a conductive endless belt made of a thermoplastic resin, such as a polycarbonate resin, PVDF (polyvinylidene fluoride), polyalkylene phthalate, PC (polycarbonate)/PAT (polyalkylene terephthalate) blended material, ETFE (ethylene tetrafluoroethylene copolymer)/PC, ETFE/PAT, PC/PAT blended materials, and others (see, for example, JP-A No. 6-095521, JP-A No. 5-200904, JP-A No. 6-228335, JP-A No. 6-149081, JP-A No. 6-149083, and JP-A No. 6-149079).

As a semiconductive belt used for an intermediate transfer belt or a transport belt, an intermediate transfer belt formed by dispersing a conductive filler in a polyimide resin excellent in mechanical characteristics and heat resistance is proposed (see, for example, JP-A No. 5-77252 and JP-A No. 10-63115).

However, since the above-mentioned intermediate transfer belt is high in hardness, it is inferior in toner transfer property, and recently color paper or special paper having an undulated surface by embossing comes to be used, and since following property of the belt with respect to such paper is especially poor, toner transfer property thereof is extremely inferior.

As the rubber belt used in the image forming apparatus employing the intermediate transfer medium system, an elastic belt with a reinforcing material formed by laminating a polyester or other woven material and an elastic member is proposed (see, for example, JP-A No. 9-305038 and JP-A No. 10-240020). However, the elastic belt with a reinforcing material has problems of color deviation due to creep deformation of the belt material over time.

Multilayer belts are also proposed, such as a multilayer endless belt made of plastics, or a belt having a polyolefin urethane layer applied on the surface of a rubber belt (see, for example, JP-A No. 11-24428 and JP-A No. 11-45015).

However, since the multilayer endless belt made of plastics is high in hardness as the case described above, the toner transfer property is poor, and recently color paper or special paper having an undulated surface by embossing comes to be used, and since following property of the belt with respect to such paper is especially poor, toner transfer property thereof is extremely inferior. Besides, since stress on the belt is heavy, the toner is likely to be broken, toner filming on the belt occurs, and it is inferior in durability.

The belt having a polyolefin urethane (which is a thermoplastic elastomer) layer applied on the surface of a rubber belt is a belt formed by spraying the polyolefin urethane on the rubber belt, and thus fluctuations of coat film thickness occur in the plane direction, and the dimensional accuracy is low. Still worse, polyolefin urethane is large in waste (deformation by aging), and adverse effects are caused on copy images.

Another proposal is a two-layer belt using thermosetting urethane resins, having a surface layer made of a thermosetting urethane resin with JIS A hardness of 30 to 70 degrees, and a substrate made of a thermosetting urethane resin with JIS A hardness of 75 degrees or more (see, for example, JP-A No. 2001-282009), by which a favorable transfer image quality is obtained using paper with low surface smoothness.

However, when the surface layer is made of an elastic member of a thermosetting urethane resin, microslip occurs between it and the opposite image carrier, and color registration deteriorates. Further, as the substrate, the thermosetting urethane resin with high hardness is used, and since the Young's modulus is lower as compared with resin materials, the belt thickness must be increased in order to obtain enough strength. As a result of increasing the thickness of the substrate, surface layer deformation increases at the roll bend portion, and the surface layer deteriorates in a long time of use, and favorable transfer image quality becomes unobtainable.

SUMMARY OF THE INVENTION

The present invention has been made in view of the above circumstances and provides a semiconductive belt favorable in toner transfer property even with respect to paper having large undulations such as embossed paper on which printing with high image quality has conventionally been difficult, excellent in forming of a nip shape in a transfer area, extremely low in image defects such as a hollow character in a line image or toner scatter (blur) in a transfer image, low in occurrence of microslip, capable of suppressing deterioration of color registration occurring when using an elastic layer, and capable of stably obtaining transfer images with high quality, as well as an image forming apparatus using the same.

That is, the invention provides a semiconductive belt comprising a substrate and a surface layer, wherein the substrate comprises a resin; the Young's modulus of the substrate is 1000 to 8000 MPa; the surface layer comprises a lubricant component, a fibrous filling material, and an elastic material; and the durometer hardness of the surface layer is A30/S to A70/S, and provides an image forming apparatus comprising the semiconductive belt.

DETAILED DESCRIPTION OF THE INVENTION

<Semiconductive Belt>

Figure 1:
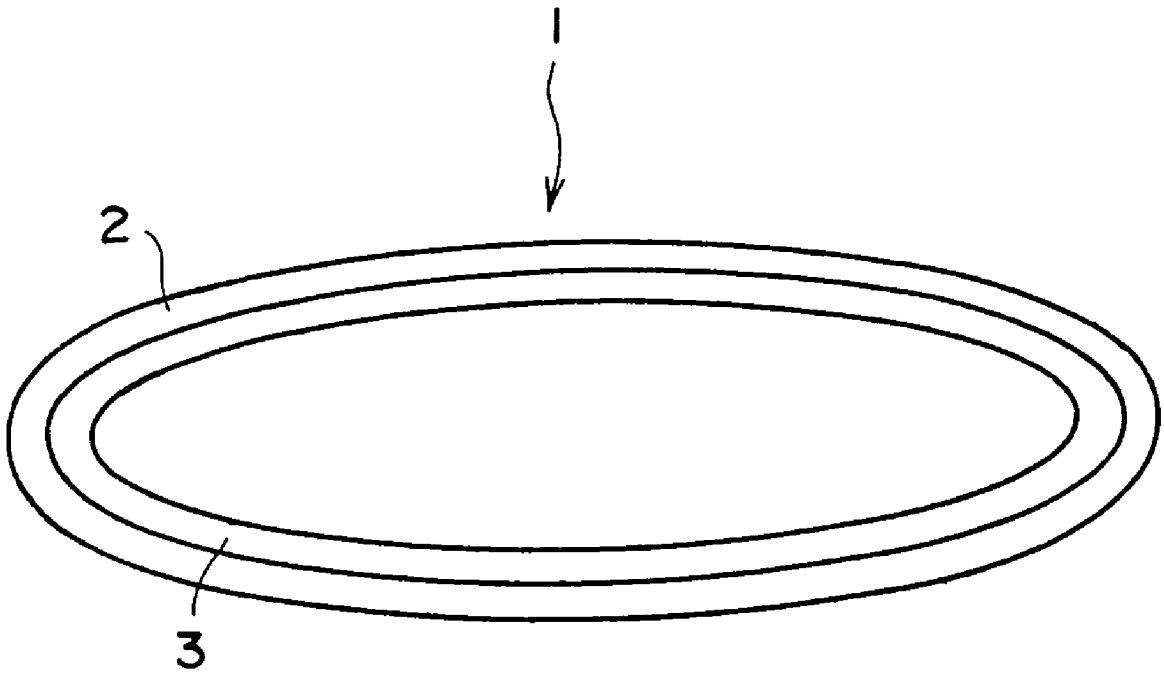
FIG. 1 is a sectional view showing the structure of a semiconductive belt of the invention.

The semiconductive belt of the present invention is explained by referring to FIG. 1. FIG. 1 is a sectional view of the structure of an example of a semiconductive belt of the invention. This semiconductive belt 1 is a two-layer endless belt consisting of a surface layer 2 and a substrate 3. The surface layer 2 comprises a lubricant component, a fibrous filling material, and an elastic material, and its durometer hardness is A30/S to A70/S. The substrate 3 comprises a resin, and its Young's modulus is 1000 to 8000 MPa. Since the semiconductive belt of the invention has at least the surface layer 2 and the substrate 3, balance of flexibility and rigidity can be satisfied, which cannot be obtained in a single material composition. Therefore it can be favorably used as an intermediate transfer belt or a paper transport belt in an electrophotographic apparatus or other image forming apparatus. The semiconductive belt of the invention can be further provided with an elastic layer, surface protective layer, or other layers, in addition to the surface layer 2 and substrate 3, within a scope not reducing the effects of the invention. Components of the semiconductive belt are described below.

(Surface Layer)

The surface layer of the semiconductive belt of the invention comprises a lubricant component, a fibrous filling material, and an elastic material, and its durometer hardness is A30/S to A70/S. Further, by using a thermosetting elastomer as the elastic material, the surface layer smaller in deformation over time and excellent in durability can be formed.

Since the semiconductive belt of the invention contains a lubricant component in its surface layer, toner filming on the belt hardly occurs, and there is no problem of tacking with an opposing image carrier. Further, by orienting the fibrous filling material in a direction along the belt surface (direction vertical to thickness direction), deformation of the surface layer can be suppressed, and there is no problem of microslip, which occurs when the surface layer is made of a single elastic material.

Elastic Material

Examples of the elastic material usable in the surface layer of the invention include a thermosetting elastomer. The thermosetting elastomer may be any resin having a urethane bond or ester bond in the repetition unit. Above all, a polyurethane resin is preferred from the viewpoint of softness of the obtained semiconductive belt surface layer.

Lubricant Component

The lubricant component is not particularly limited as long as it can provide lubricity, and a fluorine compound and fluoroplastic powder may be preferably used.

Examples of the fluorine compound include a polyalkyl (meth)acrylate, polyester, polycarbonate, or polyurethane, having a part of the molecular structure replaced by a fluorine atom or a fluorine atomic group. For example, a compound of a methyl methacrylate perfluoroalkyl methacrylate copolymer main chain treated by grafting with a polymethyl methacrylate side chain is available as Chemtree LF-700 of Soken Chemical & Engineering Co., Ltd. The fluorine compound may be used either alone or in combination of two or more types.

The addition amount of the fluorine compound is preferably in a range of 10 to 60 parts by mass and more preferably in a range of 20 to 50 parts by mass based on 100 parts by mass of the elastic material. If the addition amount is less than 10 parts by mass, lubricity may not be expressed, and if exceeding 60 parts by mass, the thermosetting elastomer forming the surface layer may be softened, and microslip may occur as mentioned above.

Examples of the fluoroplastic powder include polyvinyl fluoride, PVDF, tetrafluoroethylene (TFE) resin, chlorotrifluoroethylene (CTFE) resin, ETFE, CTFE-ethylene copolymer, PFA (TFE-perfluoroalkyl vinyl ether copolymer), FEP (TFE-hexafluoropropylene (HEP) copolymer), EPE (TFE-HFP-perfluoroalkyl vinyl ether copolymer), etc. They can be used either alone or in combination of two or more types.

The fluoroplastic powder is preferably a fine powder having a volume average particle diameter of 0.1 to 1 μm. If the volume average particle diameter is less than 0.1 μm, lubricity may not be expressed, and if exceeding 1 μm, the intermediate transfer belt surface may be rough, and transfer property may become worse. The addition amount of the fluoroplastic powder is preferably in a range of 5 to 80 parts by mass and more preferably in a range of 10 to 60 parts by mass based on 100 parts by mass of the elastic material. If the addition amount is less than 5 parts by mass, lubricity may not be expressed, and if exceeding 80 parts by mass, the thermosetting elastomer forming the surface layer is stiffened, and following property may not be obtained with respect to special paper such as color paper or embossed paper.

Fibrous Filling Material

Length of the fibrous filling material is preferably in a range of 0.1 to 20 mm, and more preferably 0.5 to 10 mm. If the length is less than 0.1 mm, it may be difficult to orient the long axis in a direction along the belt surface (direction vertical to thickness direction), and if exceeding 20 mm, the long axis may be bent in the belt thickness direction.

Fineness of the fibrous filling material is preferably in a range of 10 to 60 tex (1 tex=$1\times10^{-6}$ kg/m), and more preferably in a range of 20 to 50 tex. If the fineness is less than 10 tex, large amount of the fibrous filling material must be blended in the surface layer in order to prevent microslip and the mechanical property may thus be lowered, and if exceeding 60 tex, smoothness of the belt surface may be spoiled, or processing property of the surface layer may be impaired and thereby it may become impossible to form the surface layer.

The fibrous filling material is preferably short fibers of resin. Examples of the short fibers of resin include fibers of cotton, hemp, silk, rayon, acetate, nylon, acrylic, vinylon, vinylidene, polyester, polystyrene, polypropylene, aramid, and other resins. In particular, aramid fibers are preferably used because the fibrous shape can be maintained at the heating temperature of 80 to 160° C. in forming process of thermosetting urethane resin. For example, chopped fibers having a fiber length of 0.6 to 6 mm such as Cornex of TEIJINTECHNO PRODUCTS LIMITED may be preferably used.

The addition amount of the fibrous filling material is preferably in a range of 10 to 40 parts by mass and more preferably in a range of 20 to 30 parts by mass based on 100 parts by mass of the elastic material. If the addition amount is less than 10 parts by mass, sufficient strength may not be obtained even if combined with other reinforcing agent, and if exceeding 40 parts by mass, the processing property may be impaired and thereby forming of the layer may become impossible.

In order to orient the long axis of the fibrous filling material in a direction along the belt surface (direction vertical to the thickness direction), tendency of the fibrous filling material to be oriented in the forming direction can be used. For example, a solution containing a fibrous filling material is applied on a layer formed outside or inside of a cylindrical metal mold while rotating (centrifugal forming method), or is applied on the outermost surface of a cylindrical metal mold by immersing the cylindrical metal mold having a layer formed at the outer side in a solution containing the fibrous filling material, and pulling it out (dip forming method), and thereby the long axis can be oriented in a direction along the belt surface (direction vertical to the thickness direction).

The long axis of the fibrous filling material is thus oriented in a direction along the belt surface (direction vertical to the thickness direction), thereby deformation of the surface layer can be suppressed and there is no problem of microslip occurring when a single elastic material is used as a surface layer.

The durometer hardness of the surface layer is in a range of A30/S to A70/S and preferably in a range of A40/S to A60/S based on JIS K 6253. By specifying the durometer hardness of the surface layer in this range, following property with respect to special paper such as color paper or embossed paper is improved, and thereby the toner transfer property is improved not only on ordinary paper but also on the special paper, so that transfer images with high quality can be stably obtained. If the durometer hardness of the surface layer is less than A30/S, the surface layer may be injured by a metallic cleaning member or a paper dust (calcium carbonate contained in paper), and if exceeding A70/S, following property with respect to special paper such as color paper or embossed paper is lowered and thereby the toner transfer property may be worsen. The durometer hardness of the surface layer conforms to JIS K 6253, and sheets of the surface layer are laminated to 6 mm thickness, and the standard hardness thereof is measured by using a type A durometer. To adjust the durometer hardness of the surface layer in this range, types of the elastic material are properly selected, and the lubricant component and fibrous filling material are properly adjusted within the above specified range.

Ten-point average surface roughness Rz of the surface layer may be selected appropriately, and is preferably 1.5 to 9.0 μm. If less than 1.5 μm, the surface layer may adhere to the contacting image carrier or other member, and if exceeding 9.0 μm, toner or other image material may stick to the layer, and thereby half-tone unevenness or other picture quality deterioration may occur. Ten-point average surface roughness Rz is a surface roughness specified in JIS B 0601. The surface roughness Rz can be controlled by the addition amounts of a lubricant component and a fibrous filling material.

(Substrate)

The Young's modulus of the substrate is 1000 MPa or more, preferably 1500 MPa or more, and more preferably 2000 MPa or more. By using a substrate with a Young's modulus of 1000 MPa or more, displacement of the belt due to disturbance (load fluctuation) when driving the belt is smaller, and thus the belt deformation due to driving stress is smaller, so that favorable image quality can be stably obtained. By this substrate composition, the belt can more effectively satisfy the balance of flexibility and rigidity that cannot be obtained by a single material composition. A larger Young's modulus is desired for the substrate, but practically it is 8000 MPa or less, and more preferably 6000 MPa or less. The Young's modulus of the substrate can be controlled within the specified range by selecting the chemical structure of the resin materials to be used, and, for example, a material containing an aromatic ring structure can be high in Young's modulus.

The Young's modulus is measured by a tensile test based on JIS K 7127, wherein a tangent is drawn in an initial strain region of obtained stress and strain curves, and the inclination is determined.

Examples of the resin material for the substrate include a polyimide resin, polyamide imide resin, fluoroplastic resin, vinyl chloride and vinyl acetate copolymer, polycarbonate resin, polyethylene terephthalate resin, vinyl chloride resin, ABS resin, polymethyl methacrylate resin, polybutylene terephthalate resin, etc. They can be used either alone or in combination of two or more types. Among them, a polyimide resin is preferably used because it is excellent in both strength and flexural fatigue resistance.

Polyimide resin can be obtained by a reaction of, for example, an aromatic tetracarboxylic acid component and an aromatic diamine component in an organic polar solvent.

Examples of the aromatic tetracarboxylic acid component include pyromellitic acid, naphthalene-1,4,5,8-tetracarboxylic acid, naphthalene-2,3,6,7-tetracarboxylic acid, 2,3,5,6-biphenyl tetracarboxylic acid, 2,2',3,3'-biphenyl tetracarboxylic acid, 3,3',4,4'-biphenyl tetracarboxylic acid, 3,3,4,4'-diphenylether tetracarboxylic acid, 3,3',3,4'-benzophenone tetracarboxylic acid, 3,3',4,4'-diphenylsulfone tetracarboxylic acid, 3,3',4,4'-azobenzene tetracarboxylic acid bis(2,3-dicarboxyphenyl)methane, bis(3,4-dicarboxyphenyl)methane, P,P-bis (3,4-dicarboxyphenyl)propane, β,β-bis(3,4-dicaboxyphenyl)hexafluoropropane, etc. They can be used either alone or in combination of two or more types.

Examples of the aromatic diamine component include m-phenyl diamine, p-phenyl diamine, 2,4-diaminotoluene, 2,6-diaminotoluene, 2,4-diaminochlorobenzene, m-xylilene diamine, p-xylilene diamine, 1,4-diaminonaphthalene, 1,5-diaminonaphthalene, 2,6-diaminonaphthalene, 2,4'-diaminonaphthalene biphenyl, benzidine, 3,3-dimethyl benzidine, 3,3'-dimethoxy benzidine, 3,4'-diaaminophenyl ether, 4,4'-diaminodiphenyl ether (oxy-p,p'-dianiline; ODA), 4,4'-diaminodiphenyl sulfide, 3,3'-diaminobenzophenone, 4,4'-diaminophenyl sulfone, 4,4'-diaminoazobenzene, 4,4'-diaminodiphenyl methane, β,β-bis(4-aminophenyl)propane, etc. They can be used either alone or in combination of two or more types.

Examples of the organic polar solvent include N-methyl-2-pyrrolidone, N,N-dimethyl acetamide, dimethyl sulfoxide, hexamethyl phosphor triamide, etc. In these organic polar solvents, cresol, phenol, xylenol, other phenols, hexane, benzene, toluene, or other hydrocarbons may be mixed as required. These solvents may be used either alone or in combination of two or more types.

The surface layer and substrate are explained above, and as required, one or two or more types of conductive agents for giving electron conductivity and conductive agents for giving ion conductivity may be mixed and added in the surface layer and substrate.

Examples of the conductive agent for giving electron conductivity include carbon black, graphite, aluminum, nickel, copper alloy, other metal or alloy, tin oxide, zinc oxide, potassium titanate, tin oxide-indium oxide, or tin oxide-antimony oxide composite oxide, and other metal oxide.

Examples of the conductive agent for giving ion conductivity include sulfonate, ammonia salt, and various surface-active agents of cationic type, anionic type, and nonionic type. Further, a conductive polymer may be blended. Examples of the conductive polymer include polymers with a quaternary ammonium salt group such as various (for example, styrene) copolymers of (meth)acrylate having a carboxylic group with a quaternary ammonium salt group, and copolymers of maleimide and methacrylate with a quaternary ammonium salt group, polymers having alkali metal sulfonate salt such as sodium polysulfonate, polymers having at least hydrophilic unit of alkylene oxide bonded in molecular chain, for example, polyethylene oxide, polyethylene glycol type polyamide copolymer, polyethylene oxide-epichlorohydrine copolymer, block polymer having polyether amide imide or polyether as a main segment, and further polyaniline, polythiophene, polyacetylene, polypyrrole, polyphenylene vinylene, etc. These conductive polymers can be used in either undoped state or doped state. By using these conductive agents, surface-active agents, and conductive polymers either alone or in combination of two or more types, an electrical resistance can be stably obtained.

As the conductive agent, it is preferred to use oxidized carbon black of pH 5 or less because good dispersibility is obtained in the resin composition, and favorable disperse stability is thus obtained, and moreover, resistance fluctuations of the semiconductive belt are smaller, and dependence on electric field is small, and electric field concentration due to transfer voltage hardly occurs, and stability of electrical resistance over time is thus enhanced.

The addition amount of the conductive agent based on 100 parts by mass of an elastic material of the surface layer or a resin of the substrate may be 10 to 40 parts by mass of carbon black, 1 to 10 parts by mass of metal, 5 to 20 parts by mass of metal oxide, 5 to 40 parts by mass of ion conductive substance, or 5 to 30 parts by mass of conductive polymer material. If the addition amount is less than the above specified range, uniformity of the electrical resistance may be lowered, and unevenness of surface resistivity in plane or dependence on electric field may be increased. If exceeding the above specified range, desired resistance value may not be obtained. Besides, the belt strength may be lowered and toughness may be inferior, and thus it may not be used as the belt.

Examples of the method of dispersing the conductive agent and crushing its aggregate include physical techniques such as agitation by a mixer or agitator, a parallel roll, and ultrasonic wave dispersion, and chemical techniques such as feeding of dispersants, but are not limited particularly.

Volume resistivities of the surface layer and the substrate of the semiconductive belt of the invention are both preferably $1\times10^{8}$ to $1\times10^{13}$ ohm-cm, and more preferably $1\times10^{9}$ to $1\times10^{12}$ ohm-cm. If the volume resistivities of the surface layer and substrate are in a range of $1\times10^{8}$ to $1\times10^{13}$ ohm-cm, there is almost no occurrence of the problem of toner scattering (blur) around the image due to an electrostatic repulsive force between toners or due to a force of a fringe electric field near the image edge. In this range, moreover, the volume resistivity of the semiconductor belt (especially when used as the intermediate transfer medium) remains in a range in which electric charge is properly attenuated, so that the images may be continuously formed without using a destaticizer.

Figure 2A:
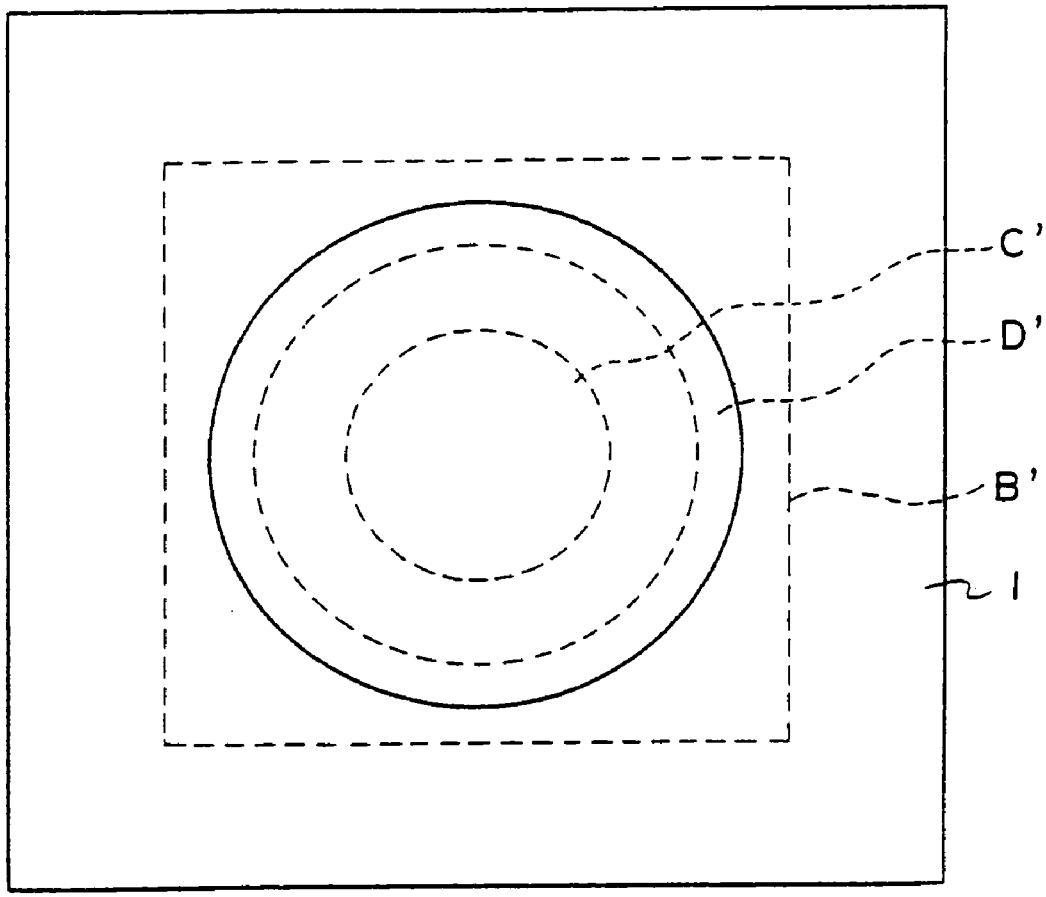
FIGS. 2A and 2B are diagrams showing the measuring method of volume resistivity.
Figure 2B:
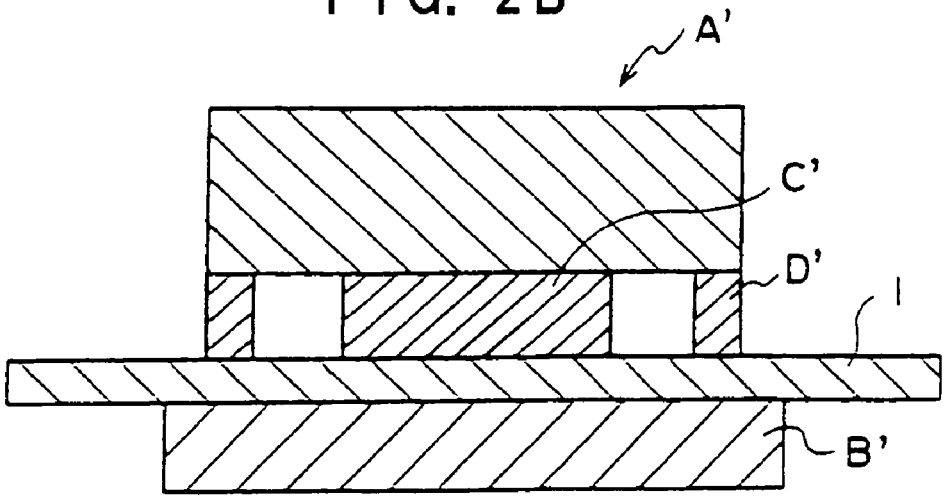

Volume resistivity can be measured according to JIS K 6911 by using a circular electrode (for example, a Highrester IP HR probe produced by Mitsubishi Petrochemical Co., Ltd.). A method of measuring volume resistivity will be explained by referring to the drawings. FIG. 2A is a schematic plan view of an example of a circular electrode, and FIG. 2B is its schematic sectional view. The circular electrode shown in FIGS. 2A and 2B includes a first voltage applying electrode A' and a second voltage applying electrode B'. The first voltage applying electrode A' has a columnar electrode part C' and a cylindrical ring electrode part D' having a larger inner diameter than the outer diameter of the columnar electrode part C' and surrounding the columnar electrode part C' at a uniform interval. A conductive belt 1 is held between the columnar electrode part C' and ring electrode part D' of the first voltage applying electrode A' and the second voltage applying electrode B', a voltage V (V) is applied between the columnar electrode part C' of the first voltage applying electrode A' and the second voltage applying electrode B', a flowing current I (A) is measured, and the volume resistivity pv (ohm-cm) of the semiconductive belt 1 can be calculated according to the following formula. In the formula, (t) refers to the thickness of semiconductive belt 1. Formula:

$$\rho v = 19.6\times(V/I)\times t$$

The total thickness of the semiconductive belt of the invention is preferably 0.05 to 0.6 mm and more preferably 0.1 to 0.5 mm. If it is less than 0.05 mm, a belt peripheral length may change due to belt tension. If the belt thickness exceeds 0.6 mm, a difference in deformation amount between the inside and outside of the belt may increase at a roll bend portion, and the surface may be cracked.

Thickness of the surface layer is preferably 60 to 90% and more preferably 70 to 85% of the total belt thickness. Thickness of the substrate is preferably 10 to 40% and more preferably 15 to 30% of the total belt thickness. In this range, pressing force concentrated on the toner on the semiconductive belt is dispersed, the toner does not aggregate, and following property with respect to special paper such as color paper or embossed paper can be improved and thus the toner transfer property with respect to such paper can be improved, and when the Young's modulus of the substrate is 1000 to 8000 MPa, mechanical characteristics for a conductive belt can be satisfied at the same time.

The semiconductive belt of the invention having such a configuration has excellent properties, such as freedom from lowering of resistance due to transfer voltage, freedom from the problem of deformation or the like due to aging effects, freedom from dependence on electric field, and little change in electrical resistance due to environment. The semiconductive belt of the invention may be preferably applied as an intermediate transfer belt or a paper transport belt used in an electrophotographic copy machine, laser printer, or other image forming apparatus.

The surface layer and the substrate may also contain conventional additives other than the conductive agents mentioned above, such as a coloring agent, stabilizer (thermal stabilizer, oxidation inhibitor, ultraviolet absorbent, etc.), filler, charging preventive agent, flame retardant, non-combustion aid, leveling agent, silane coupling agent, thermal polymerization inhibitor, etc. These additives may be used either alone or in a combination of two or more types.

The semiconductive belt of the invention may be an endless belt, and it may be formed as a seamless belt by a proper connection method such as an adhesion method of applying adhesives to film ends. The seamless belt has many merits, such as small change in thickness at a junction, whereby a rotation start position may be set to any position, and a control mechanism for a rotation start position can be omitted.

The substrate and the surface layer can be formed by an extrusion forming method, by forming materials of each layer into sheets, laminating the sheets on a metal core body, and heating the sheets, to form a two-layer belt, or by forming the substrate in a belt shape, laminating the substrate on a metal core body, and forming the surface layer thereon. Alternatively, materials of the substrate and the surface layer can be laminated and formed simultaneously, to form a two-layer belt.

<Image Forming Apparatus>

The image forming apparatus of the invention preferably comprises the semiconductive belt of the invention as an intermediate transfer medium or a paper transport belt, but is not particularly limited thereto. For example, it may be an ordinary monochromatic image forming apparatus containing only a single color toner in the developing device, a color image forming apparatus for repeating primary transfer of toner images carried on an image carrier such as a photoreceptor drum sequentially on the intermediate transfer medium, or a tandem-type color image forming apparatus having a plurality of image carriers including developers of each color disposed in series on the intermediate transfer medium.

A first embodiment of the image forming apparatus of the invention is a color image forming apparatus for repeating primary transfer of toner images carried on an image carrier such as a photoreceptor drum sequentially on an intermediate transfer medium, by using the semiconductive belt of the invention as an intermediate transfer belt. A second embodiment of image forming apparatus of the invention is a tandem color image forming apparatus having a plurality of image carriers including developers of respective colors disposed in series along an intermediate transfer medium.

Figure 3:
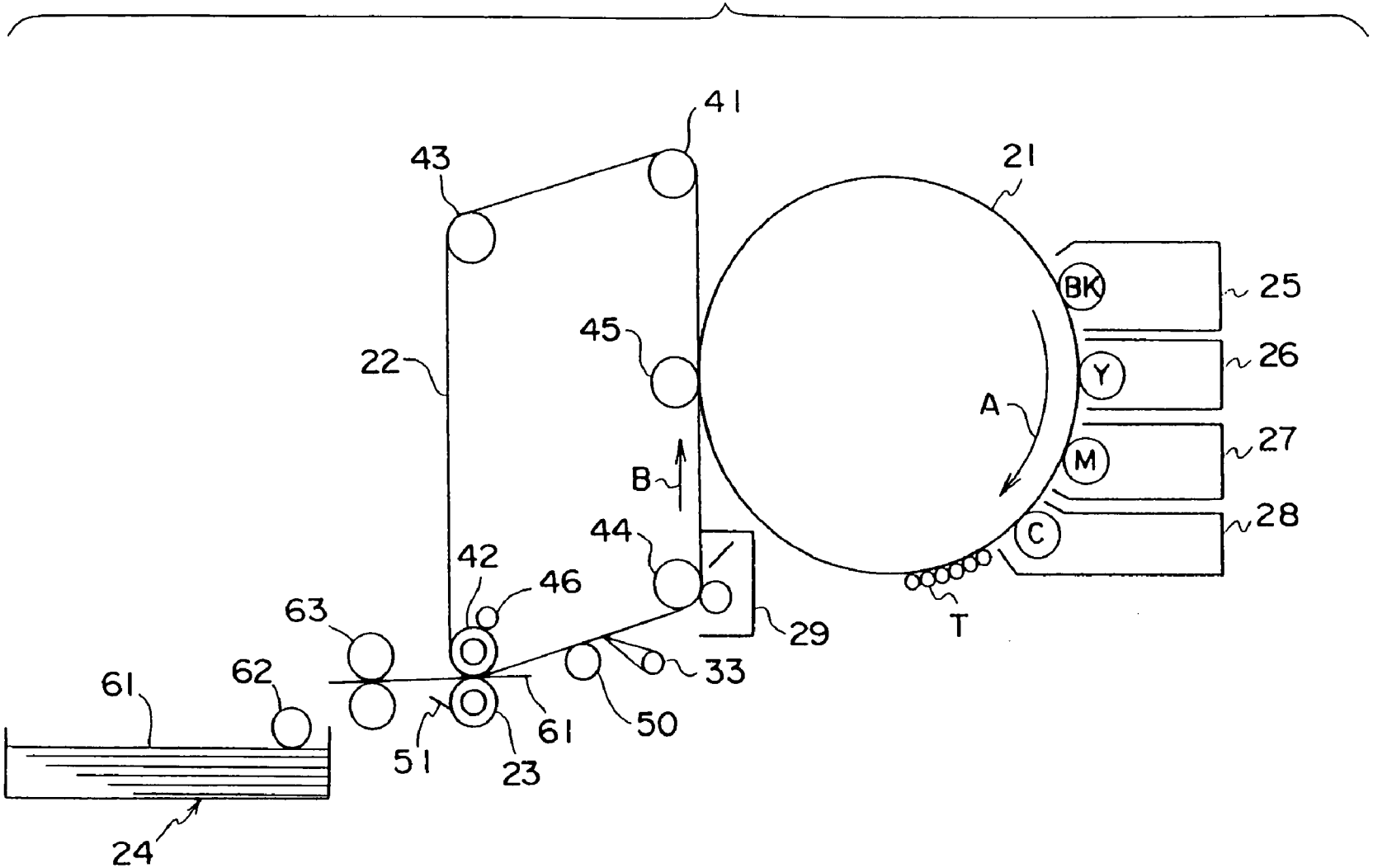
FIG. 3 is a schematic view showing main parts of an image forming apparatus according to the invention.

For example, FIG. 3 shows a schematic diagram of a color image forming apparatus for repeating primary transfer sequentially, using the semiconductive belt of the invention as an intermediate transfer belt. FIG. 3 is a schematic view showing main parts of the image forming apparatus according to the invention. The image forming apparatus comprises a photoreceptor drum 21 as an image carrier, an intermediate transfer belt 22 as an intermediate transfer medium, a bias roller 23 (second transfer means) as a transfer electrode, a paper tray 24 for supplying recording sheets as a transfer medium, a developer 25 using Bk (black) toner, a developer 26 using Y (yellow) toner, a developer 27 using M (magenta) toner, a developer 28 using C (cyan) toner, an intermediate transfer medium cleaner 29, a scraping pawl 33, belt rollers 41, 43, and 44, a backup roller 42, a conductive roller 45 (first transfer means), an electrode roller 46, a cleaning blade 51, a recording sheet 61, a pickup roller 62, a destaticizing roll (optional) 50, and a feed roller 63.

In FIG. 3, the photoreceptor drum 21 rotates in the direction of arrow A, and its surface is uniformly charged by a charger which is not shown. On the charged photoreceptor drum 21, an electrostatic latent image of a first color (for example, Bk) is formed by image writing means such as a laser writing device. The electrostatic latent image is developed by the black developer 25, and a visualized toner image T is formed. The toner image T is sent to a primary transfer section having the conductive roller 45 (first transfer means) by rotation of the photoreceptor drum 21, an electric field of reverse polarity is applied to the toner image T from the conductive roller 45, and the toner image T is electrostatically attracted to the intermediate transfer belt 22 and is primary transferred by rotation of intermediate belt 22 in the direction of arrow B.

Similarly, a toner image of a second color, a toner image of a third color, and a toner image of a fourth color are sequentially formed and overlaid on the intermediate transfer belt 22, whereby multiple toner images are formed.

The multiple toner images transferred on the intermediate transfer belt 22 are sent to a secondary transfer section having the bias roller 23 (second transfer means) by rotation of the intermediate transfer belt 22. The secondary transfer section is composed of the bias roller 23 disposed on the side of the surface, of the intermediate transfer belt 22, carrying the toner image, the backup roller 42 disposed to be opposite to the bias roller 23 at the back side of intermediate transfer belt 22, and the electrode roller 46 rotating in tight contact with the backup roller 42.

A recording sheet 61 is picked up one by one by the pickup roller 62 from a stack of recording sheets contained in the paper tray 24 and supplied by the feed roller 63 at a specified timing between the intermediate transfer belt 22 and the bias roller 23 of the secondary transfer section. The supplied recording sheet 61 is pressed and conveyed by the bias roller 23 and the backup roller 42, and due to this pressing and transport and rotation of the intermediate transfer belt 22, the toner image carried on the intermediate transfer belt 22 is transferred thereto.

The recording sheet 61 onto which the toner image has been transferred is scraped from the intermediate transfer belt 22 by operation of the scraping pawl 33, which is at a retreat position until the end of primary transfer of the final toner image, and conveyed to a fixing device which is not shown, and the toner image is fixed by a pressing and heating process, whereby a permanent image is formed. After transfer of the multiple toner images on the recording sheet 61, the intermediate transfer belt 22 is cleaned by an intermediate transfer medium cleaner 29 disposed at the downstream side of the secondary transfer section to remove residual toner and is ready for the next transfer. The bias roller 23 is disposed so as to always abut against the cleaning blade 51 made of polyurethane or the like, whereby foreign matter adhered by transfer such as toner particles and paper dust are removed.

In the case of single color image transfer, the toner image T after primary transfer is immediately sent to the process of secondary transfer and conveyed to the fixing device, but in the case of multicolor image transfer by overlaying plural colors, the intermediate transfer belt 22 and the photoreceptor drum 21 are rotated in synchronism so that the toner images of the respective colors can precisely coincide in the primary transfer section, and deviation of the toner images of the respective colors is prevented. In the secondary transfer section, by applying an output voltage (transfer voltage) of same polarity as the polarity of the toner image to the electrode roller 46 contacting tightly with the backup roller 42 disposed opposite from the bias roller 23 with the intermediate transfer belt 22 therebetween, the toner image is transferred onto the recording sheet 61 by electrostatic repulsion. Owing to the image forming apparatus having such a configuration, transfer images with high quality can be stably obtained.

Figure 4:
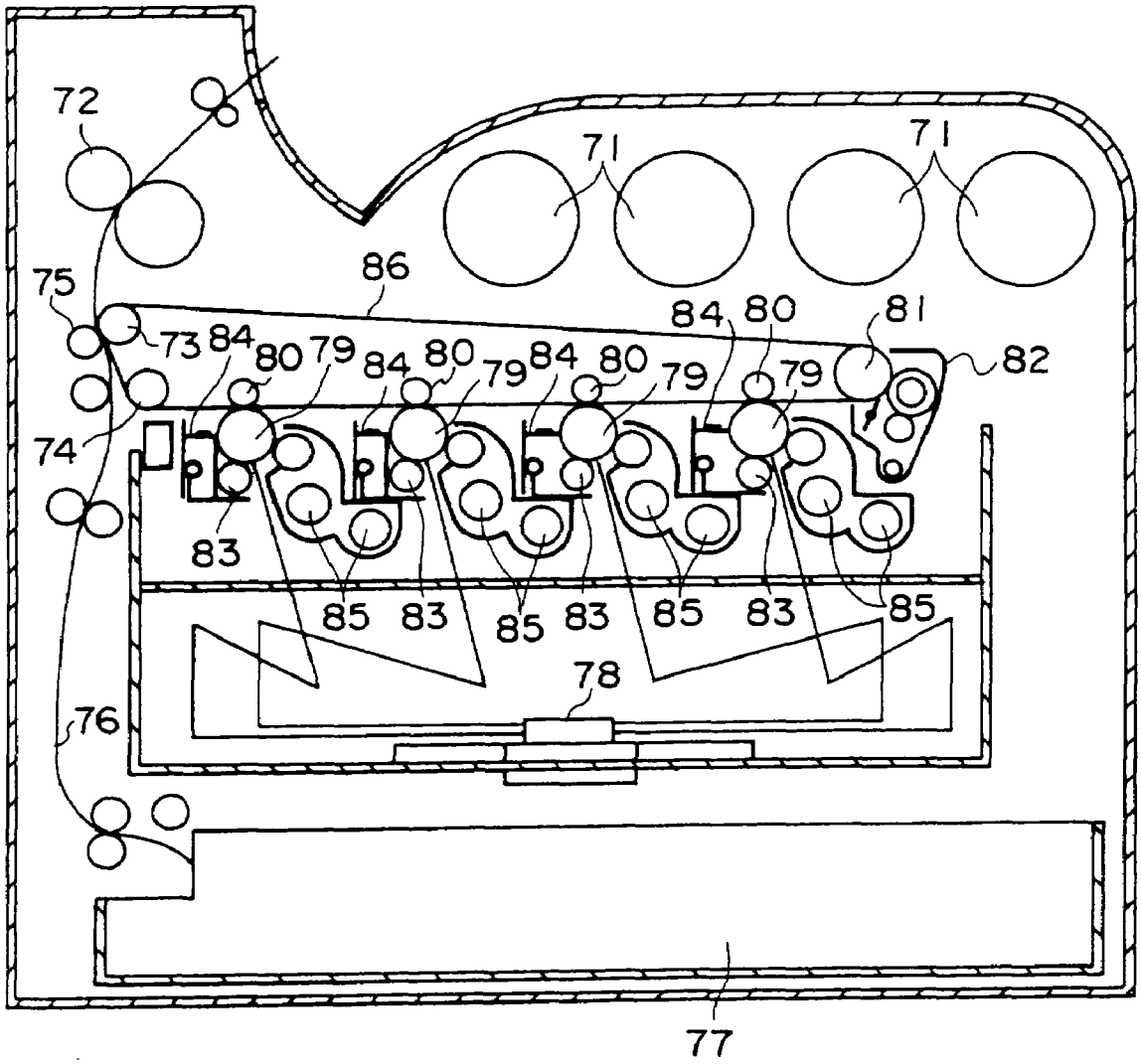
FIG. 4 is a schematic view showing main parts of a tandem system image forming apparatus according to the invention.

A second embodiment of image forming apparatus of the invention is a tandem color image forming apparatus comprising, as shown in FIG. 4, an intermediate transfer belt 86 as the semiconductive belt of the invention, a toner cartridge 71 for refilling a developer 85 of each developing unit with a developing agent, and a transfer cleaner 82 for removing toner and dust deposits on the surface of the intermediate transfer medium (intermediate transfer belt) 86, in which photoreceptors 79 of individual colors having developers 85 for four colors (black, yellow, magenta, and cyan) are disposed in contact with the intermediate transfer medium (intermediate transfer belt) 86. FIG. 4 is a schematic diagram showing main parts of the tandem image forming apparatus according to the invention. The intermediate transfer belt 86 is trained around a backup roll 73, a tension roll 74, and a driving roll 81 disposed counterclockwise sequentially at the inner peripheral side thereof.

By providing the intermediate transfer belt of the invention, transfer images of high quality can be obtained. Specifically, in FIG. 4, the apparatus arbitrarily includes, as required, charging rolls 83 (charging devices) for charging the surfaces of the photoreceptors 79 uniformly, a laser generating device 78 (exposure device) for exposing the surfaces of the photoreceptors 79 to form electrostatic latent images, developers 85 (developing devices) for developing the latent images formed on the surfaces of the photoreceptors 79 by using a developing agent to form toner images, photoreceptor cleaners 84 (cleaning devices) for removing toner and dust deposits from the photoreceptors, a fixing roll 72 for fixing the toner images on the transfer material, and others, which may be obtained by known methods. Charge of the intermediate transfer medium 86 is removed by a destaticizing roll (destaticizing means), which is not shown.

More specifically, a toner image is formed in each developing unit by a process in which the surface of the photoreceptor 79 rotating counterclockwise is uniformly charged by the charging roll 83, a latent image is formed on the charged surface of the photoreceptor 79 by the laser generating device 78 (exposure device), this latent image is developed by the developing agent supplied from the developer 85, a toner image is formed, the toner image is conveyed to the pressing part between the primary transfer roll 80 and photoreceptor 79, and it is transferred onto the outer circumference of the intermediate transfer belt 86 rotating clockwise. After transfer of the toner image, the photoreceptor 79 is cleaned by the photoreceptor cleaner 84 to remove toner and dust deposits on the surface and is ready for forming of next toner image.

Toner images formed in the developing units of the individual colors are sequentially overlaid on the outer circumference of the intermediate transfer medium 86 so as to correspond to image information, conveyed to a secondary transfer section, and transferred onto the surface of a recording sheet conveyed from a paper tray 77 by way of a sheet route 76 by a secondary transfer roll 75. The recording sheet onto which the toner images have been transferred is pressed, heated and fixed while passing through the pressing section of a pair of fixing rolls 72 constituting a fixing section, whereby an image is formed on the surface of recording medium, and the paper is discharged from the image forming apparatus. In the tandem image forming apparatus having such a configuration, transfer images of high quality can be stably obtained.

Although explanation has been given above in which the semiconductive belt of the invention is applied as the intermediate transfer belt of the image forming apparatus, the same effects are also obtained when the semiconductive belt of the invention is applied as the paper transport belt of the image forming apparatus.

When the semiconductive belt of the invention is used as the intermediate transfer belt or the transport belt which is incorporated in the image forming apparatus, it is preferable for the toner to be spherical toner. By using a spherical toner, even if the material of the transfer surface is low in durometer hardness and less likely to deform along the surface, transfer images of high quality that are free from image defects (hollow character, blur, or color registration deviation) can be obtained.

A shape factor SF of the spherical toner is preferably 100 to 140, more preferably 100 to 130, and further preferably 100 to 120. If the shape factor SF exceeds 140, the transfer efficiency is lowered, and a decline in image quality of a print sample can be sometimes visually recognized.

The shape factor SF is a coefficient defined by the following formula.

$$SF=(\text{maximum length of toner particle})^2/(\text{projected area of toner particle})\times(\pi/4)\times 100$$

The maximum length of the toner particle and the projected area of the toner particle are measured using a Luzex image analyzer (FT produced by Nireco), by taking optical microscopic images of 100 toner particles scattered on a slide glass by a video camera, putting the images into the Luzex image analyzer, and processing the images.

The spherical toner contains at least a binding resin and a coloring agent. The volume average particle diameter of the spherical toner is preferably 2 to 12 μm, and more preferably 3 to 9 μm.

Examples of the binding resin include styrene, chlorostyrene, other styrenes, ethylene, propylene, butylene, isoprene, other monoolefins, vinyl acetate, vinyl propionate, vinyl benzoate, vinyl butyrate, other vinyl esters, methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, other alpha-methylene fatty group ester monocarboxylates, vinyl methyl ether, vinyl ethyl ether, vinyl butyl ether, other vinyl ethers, vinyl methyl ketone, vinyl hexyl ketone, vinyl isopropyl ketone, other vinyl ketones, and other single polymers or copolymers. Particularly representative examples of the binding resin include polystyrene, styrene-alkyl acrylate copolymer, styrene-alkyl methacrylate copolymer, styrene-acrylonitrile copolymer, styrene-butadiene copolyrner, styrene-maleic anhydride copolymer, polystyrene, and polypropylene. Further examples are polyester, polyurethane, epoxy resin, silicone resin, polyamide, denatured rosin, and paraffin wax.

Examples of the coloring agent include magnetite, ferrite, other magnetic powder, carbon black, aniline blue, chalcoyl blue, chrome yellow, ultramarine blue, Dupont oil red, quinoline yellow, methylene blue chloride, phthalocyanine blue, malachite green oxalate, lamp black, rose bengal, C.I. pigment red 48:1, C.I. pigment red 122, C.I. pigment red 57:1, C.I. pigment yellow 97, C.I. pigment yellow 17, C.I. pigment blue 15:1, C.I. pigment blue 15:3, etc.

The spherical toner may contain known additives by either internal adding processing or external adding processing, such as a charge controller, parting agent, or other inorganic fine particles. Examples of the parting agent include a low molecular polyethylene, low molecular polypropylene, Fischer Tropsch wax, Montan wax, carnauba wax, rice wax, candelila wax, etc.

The charge controller may be made of known material, and examples of the charge controller include an azo metal complex compound, salicylic acid metal complex compound, resin type charge controller having a polar group. When manufacturing the toner in a wet process, it is preferred to use a material hardly dissolved in water from the viewpoint of control of the ion intensity and reduction of the contaminated wastewater.

As other inorganic fine particles, inorganic fine particles of small diameter, which has a number-average primary particle diameter of 40 nm or less, may be used for the purpose of controlling the powder fluidity or charge property. Further, as required, inorganic or organic fine particles with larger diameter may be used in addition thereto for decreasing the adhesion power. These other inorganic fine particles may be selected from known materials. Examples thereof include silica, alumina, titania, methatitanate, zinc oxide, zirconia, magnesia, calcium carbonate, magnesium carbonate, calcium phosphate, cerium oxide, strontium titanate, etc.

The inorganic fine particles of small diameter are preferably surface treated because the dispersion is improved and the powder fluidity is enhanced.

The spherical toner is not particularly limited by the manufacturing method, and may be manufactured by any known method. For example, the toner is manufactured by a kneading and pulverizing method of kneading, pulverizing and sorting a binding resin and a coloring agent, together with a parting agent and a charge controller as required; by a method of changing the shape of the particles obtained from the kneading and pulverizing method by mechanical impact or thermal energy; by an emulsification, polymerization, and aggregation method of emulsifying and polymerizing a polymerizable monomer for a binding resin, mixing the formed dispersion liquid and a coloring agent, together with a dispersion liquid containing a parting agent and a charge controller as required, and aggregating, heating and fusing the mixture to obtain a spherical toner; by a suspension polymerization method of suspending a polymerizable monomer for obtaining a binding resin, and a coloring agent, together with an solution containing a parting agent and a charge controller as required, in an aqueous solvent, and polymerizing; or by a dissolving suspension method of suspending a binding resin, and a coloring agent, together with a solution containing a parting agent and a charge controller as required, in an aqueous solvent, and granulating. Further, a manufacturing method can be available in which using the spherical toner obtained by the above method as a core, aggregating particles are adhered, heated and fused to make a core-shell structure. When adding an external additive, the spherical toner and external additive may be mixed by a Henschel mixer or V-blender. When manufacturing the spherical toner in a wet process, an external additive may be added in a wet process.

EXAMPLES

Examples of the present invention are explained below, but the invention is not limited to these examples.

Preparation of Polyamide Acid Solution (A)

100 parts by mass of a mixture (mass ratio is 2:1) of 3,3',4,4'-biphenyl tetracarboxylic dianhydride (BPDA) and pyromellitic dianhydride (PMDA) as a tetracarboxylic dianhydride, and 134.3 parts by mass of 4,4'-diaminodiphenyl ether (DDE) as a diamine component are reacted in a N-methyl-2-pyrrolidone (NMP) solution kept at 10° C. to prepare a NMP solution with a solid content of 20% by mass. To this solution, 24 parts by mass of a dried oxidized carbon black (SPECIAL BLACK 4 manufactured by Degussa, pH 3.0, volatile component: 14.0%) is added based on 100 parts by mass of the polyamide acid resin solid content, and then, by using a collision type dispersing apparatus (Geanus PY manufactured by Seanus) in which the pressure is set at 200 MPa, an operation of dividing into two parts followed by colliding in a minimum area of 1.4 $mm^2$ is repeated five times for mixing the solution to prepare a polyamide acid solution (A).

Preparation of Polyamide Acid Solution (B)

To a N-methyl-2-pyrrolidone (NMP) solution containing a polyamide acid composed of 3,3',4,4'-biphenyl tetracarboxylic dianhydride (BPDA) and 4,4'-diaminodiphenyl ether (DDE) (U-Vamish A produced by Ube Kosan, solid content: 20% by mass), 26 parts by mass of a dried oxidized carbon black (SPECIAL BLACK 4 manufactured by Degussa, pH 3.0, volatile component: 14.0%) is added based on 100 parts by mass of the polyamide acid resin solid content, and then, the solution is mixed by the same operation as in the preparation of the polyamide acid solution (A), whereby a polyamide acid solution (B) is prepared.

(Preparation of Substrate (A))

The polyamide acid solution (A) is applied at a thickness of 0.4 mm on an inner surface of a cylindrical metal mold with an inner diameter of 168.2 mm and a length of 500 mm by using a dispenser, rotated for 15 minutes at 1500 rpm to obtain a uniform thickness, dried for 30 minutes by blowing hot air of 60° C. from outside of the metal mold while rotating at 250 rpm, and heated for 60 minutes at 150° C. to remove the solvent. After that, the cylindrical metal mold is brought back to room temperature, a polyamide acid molded article is peeled from the cylindrical metal mold and is applied on a metal core with an outer diameter of 168 mm and a length of 500 mm. The metal core is heated up to 360° C. at a temperature rising rate of 2° C. per minute, and further heated for 30 minutes at 360° C. to complete the imide conversion reaction. Then bringing it back to room temperature, the resin is peeled from the metal core to obtain a desired substrate (A).

The thickness of the obtained substrate (A) is 0.08 mm. The Young's modulus thereof is 2500 MPa, and the volume resistivity thereof is $5\times10^{10}$ ohm-cm.

Young's Modulus

In the invention, the Young's modulus of the substrate is measured in accordance with JIS K 7127 by using FA1015A produced by Aiko Engineering. The substrate is cut into a size of 5 mm×40 mm for a test sample, a tensile test is conducted at a test speed of 50 mm/min, a tangent is drawn to a curve of initial strain region of the obtained stress and strain curves, and from the inclination, the Young's modulus is determined.

Volume Resistivity

The volume resistivity is measured as mentioned above, by using a circular electrode shown in FIG. 2 (Highrestor IP HR probe produced by Mitsubishi Petrochemical Co., Ltd.), in the environment of 22° C. and 55% RH, by applying a voltage (100 V) between the columnar electrode part C' of the first voltage applying electrode A' and the second voltage applying electrode B', from the current value after 10 seconds.

(Preparation of Substrate (B))

Substrate (B) is prepared in the same manner as in substrate (A) except that polyamide acid solution (B) is used instead of polyamide acid solution (A) and that the imide conversion reaction temperature is 400° C.

Thickness of the obtained substrate (B) is 0.08 mm. Its Young's modulus is 3800 MPa, and volume resistivity is $5\times10^{16}$ ohm-cm.

Preparation of Surface Layer Material (A)

Surface layer material (A) is prepared by mixing 100 parts by mass of isocyanate prepolymer (TC-551 of Nippon Polyurethane Industry Co., Ltd), 93 parts by mass of polyol (ON-D56 of Nippon Polyurethane Industry Co., Ltd), 20 parts by mass of carbon black (Printex 140U, pH 4.5%, of Degussa Japan Co., Ltd) as a conductive agent, 50 parts by mass of lubricant component (Chemtree LF-700 of Soken Chemical & Engineering Co., Ltd.), and 20 parts by mass of chopped strand (fineness 39 tex) of 0.6 mm long aramid fibers (Comex of Teijin) as resin short fibers, for 1 hour by ball mill.

Preparation of Surface Layer Material (B)

Surface layer material (B) is prepared in the same manner as in surface layer material (A) except that 100 parts by mass of MC-B86 (Nippon Polyurethane Industry Co., Ltd) is used instead of isocyanate prepolymer TC-551, 277 parts by mass of ON-D55 (Nippon Polyurethane Industry Co., Ltd) is used instead of polyol ON-D56, and the contents of conductive agent and lubricant component are changed to 40 parts by mass and 35 parts by mass respectively.

Preparation of Surface Layer Material (C)

Surface layer material (C) is prepared in the same manner as in surface layer material (A) except that the lubricant component is changed to 30 parts by mass of fluoroplastic powder with a volume-average particle diameter of 0.2 μm (Lubron L-5 by Daikin Industries, LTD.).

Volume-average particle diameter of the lubricant component is measured by using a laser diffraction particle size distribution analyzer (LA-700 by Horiba). In the measurement, a sample in a dispersion liquid state having a solid content of about 2 g is prepared, and ion exchange water is added thereto to make up 40 ml. It is charged into a cell so as to have a proper concentration, and then after about 2 minutes, when the concentration in the cell is nearly stabilized, the measurement is carried out. The obtained volume-average particle diameter of each channel is accumulated from the smaller volume-average particle diameter, and the volume-average particle diameter is determined at 50% accumulation.

Preparation of Surface Layer Material (D)

Surface layer material (D) is prepared in the same manner as in surface layer material (C) except that the addition amount of polyol is changed to 88 parts by mass.

Preparation of Surface Layer Material (E)

Surface layer material (E) is prepared by mixing 100 parts by mass of isocyanate prepolymer (Coronate 4370 by Nippon Polyurethane Industry Co., Ltd), 80 parts by mass of polyol (Nippolan 4378 by Nippon Polyurethane Industry Co., Ltd), and 22 parts by mass of carbon black (Printex 140U, pH 4.5%, by Degussa Japan Co., LTD) as a conductive agent, for 1 hour by a ball mill.

Preparation of Surface Layer Material (F)

Surface layer material (F) is prepared in the same manner as in surface layer material (A) except that the lubricant component and fibrous filling material are not added.

Example 1

A cylindrical metal mold with an outer diameter of 168 mm and length of 500 mm is coated with the substrate (A), and a solution of the surface layer material (A) is uniformly applied on the outside surface thereof. While rotating in a heating furnace, the metal mold is heated for 120 minutes at a temperature of 80° C. to cure the surface layer material (A). After the heating process, inside of the furnace is returned to normal temperature and pressure, and the metal mold is taken out. The resin is removed from the metal mold, and a semiconductive belt with an inner diameter of 168 mm, width of 350 mm, and thickness of 0.33 mm is obtained. With respect to the thickness of each layer of this belt, the surface layer has a 0.25 mm thickness, and the substrate has a 0.08 mm thickness. Volume resistivity of the surface layer is $7\times10^{11}$ ohm-cm. Durometer hardness of the surface layer is A45/S.

Durometer Hardness

Durometer hardness of the surface layer conforms to JIS K 6253, only the surface layers are laminated to a thickness of 6 mm, and standard hardness thereof is measured by using a durometer type A (ASKER A by Kobunshi Keiki Co., LTD.).

Example 2

A semiconductive belt with an inner diameter of 168 mm, width of 350 mm, and thickness of 0.33 mm is prepared in the same manner as in example 1 except that the surface layer material (B) is used instead of the surface layer material (A). With respect to the thickness of each layer of this belt, the surface layer has a 0.25 mm thickness, and the substrate has a 0.08 mm thickness. Volume resistivity of the surface layer is $9\times10^{11}$ ohm-cm. Durometer hardness of the surface layer is A32/S.

Example 3

A semiconductive belt with an inner diameter of 168 mm, width of 350 mm, and thickness of 0.48 mm is prepared in the same manner as in example 1 except that the substrate (B) is used instead of the substrate (A), and that the surface layer material (C) is used instead of the surface layer material (A). With respect to the thickness of each layer of this belt, the surface layer has a 0.40 mm thickness, and the substrate has a 0.08 mm thickness. Volume resistivity of the surface layer is $1\times10^{13}$ ohm-cm. Durometer hardness of the surface layer is A55/S.

Example 4

A semiconductive belt with an inner diameter of 168 mm, width of 350 mm, and thickness of 0.43 mm is prepared in the same manner as in example 1 except that the surface layer material (D) is used instead of the surface layer material (A). With respect to the thickness of each layer of this belt, the surface layer has a 0.35 mm thickness, and the substrate has a 0.08 mm thickness. Volume resistivity of the surface layer is $1\times10^{12}$ ohm-cm. Durometer hardness of the surface layer is A70/S.

<Comparative Example 1>

A semiconductive belt with an inner diameter of 168 mm, width of 350 mm, and thickness of 0.48 mm is prepared in the same manner as in example 1 except that the surface layer material (E) is used instead of the surface layer material (A). With respect to the thickness of each layer of this belt, the surface layer has a 0.4 mm thickness, and the substrate has a 0.08 mm thickness. Volume resistivity of the surface layer is $5\times10^{10}$ ohm-cm. Durometer hardness of the surface layer is A82/S.

Comparative Example 2

A semiconductive belt with an inner diameter of 168 mm, width of 350 mm, and thickness of 0.38 mm is prepared in the same manner as in example 1 except that the surface layer material (F) is used instead of the surface layer material (A). With respect to the thickness of each layer of this belt, the surface layer has a 0.30 mm thickness, and the substrate has a 0.08 mm thickness. Volume resistivity of the surface layer is $1\times10^{11}$ ohm-cm. Durometer hardness of the surface layer is A45/S.

Comparative Example 3

Only the substrate (A) is used as a semiconductive belt of comparative example 3.

<Evaluation>

With respect to the semiconductive belts obtained in examples 1 to 4 and comparative examples 1 to 3, transfer image quality (blur, hollow character, color registration deviation) after continuous output of 10000 sheets and transport performance with embossed paper are evaluated. Results are shown in Table 1.

(Evaluation of Transfer Image Quality)

The obtained semiconductive belt is mounted on an image forming apparatus obtained by modifying Docu Color 1255CP produced by Fuji Xerox Co., Ltd., and transfer image quality after continuous output of 10000 sheets is evaluated. A spherical toner, which has a shape factor (SF) of 132 and volume-average particle diameter of 5.5 μm, is used.

Volume-average particle diameter of the toner is measured by Coulter Counter TA-II (produced by Beckmann Coulter), and the electrolyte solution used is Isoton-II (produced by Beckmann Coulter).

In the measurement, 1.0 mg of sample is added in 2 ml of 5% aqueous solution of sodium alkylbenzene sulfonate as a dispersant. This is added in 100 ml of the electrolyte solution to prepare an electrolyte solution suspending the sample. The electrolyte solution suspending the sample is dispersed for 1 minute in an ultrasonic dispersion machine, and particle diameter distribution of 2 to 60 μm particles is measured by Coulter Counter TA-II, using 100 μm aperture as aperture diameter, to determine the volume-average particle diameter. The number of the measured particles is 50000.

Evaluation of Blur

Occurrence of blur (scattering of toner) is evaluated in the following criterion.

A: There is slight blur, and is no problem in image quality.

B: There is blur, and is a slight problem in image quality.

C: There is blur, and is a problem in image quality.

Evaluation of Hollow Character

Occurrence of hollow character (hollow of line image in transfer image) is evaluated in the following criterion.

A: no problem in image quality

B: slight occurance,slightly problematic in image quality

C: problematic in image quality

Evalution of color registration deviation-Occurence of color registration deviation is evaluated in the following criterion.

A: no problem in image quality

B: slight occurrence, slightly problematic in image quality

C: problematic in image quality (Evaluation of Transporting Performance with Embossed Paper)

The obtained semiconductive belt is mounted on an image forming apparatus obtained by modifying Docu Color 1255CP produced by Fuji Xerox Co,.Ltd. Embossed paper with 50 μm bumps is transported therein, and image quality is evaluated according to the following criterion when copying halftone of magenta 30%. The toner used is a spherical toner having a shape factor (SF) of 125 and volume-average particle diameter of 5.5 μm.

A: no problem in image quality during a continuous transporting test on 1000 sheets B: no serious problem in image quality during a continuous transporting test on 1000 sheets C: problematic in image quality

TABLE 1

| | Example 1 | Example 2 | Example 3 | Example 4 | Comparative example 1 | Comparative example 2 | Comparative example 3 |
|---|---|---|---|---|---|---|---|
| Transfer image quality (blur) | B | B | A | A | C | B | C |
| Transfer image quality (hollow character) | A | A | A | A | B | A | C |
| Color registration deviation | A | A | A | A | B | C | A |
| Transporting performance with embossed paper | A | A | A | A | B | A | C |
| Overall evaluation | A | A | A | A | C | C | C |

As known from the results in Table 1, the semiconductive belts of examples 1 to 4 of the invention are free from image defects, and stably provide excellent image quality for a long period. The semiconductive belt of comparative example 1 is slightly high in durometer hardness of the surface layer, thus is not suited to transporting embossed paper, shows a slight microslip, and is impaired in color registration. The semiconductive belt of comparative example 2 is low in durometer hardness of the surface layer and is hence suited to embossed paper, but is impaired in color registration due to occurrence of microslip. The semiconductive belt of comparative example 3 has a surface made of hard resin and thus is excellent in color registration, but is not suited to embossed paper at all.

As described above, the invention can provide a semiconductive belt favorable in toner transfer property even with respect to paper having large undulations such as embossed paper on which printing with high image quality has conventionally been difficult, excellent in forming of a nip shape in a transfer area, extremely low in image defects such as a hollow character, toner scatter (blur) or color registration deviation in a line image in a transfer image, low in occurrence of microslip, capable of suppressing deterioration of color registration occurring when using an elastic layer. The semiconductive belt can be favorably used as an intermediate transfer belt or a paper transport belt in an electrophotographic apparatus, and when applied in an electrophotographic apparatus, transfer images with high quality can be stably obtained.

What is claimed is:

1. A semiconductive belt comprising a substrate and a surface layer, wherein:

the substrate comprises a resin;

the Young's modulus of the substrate is 1000 to 8000 MPa;

the surface layer comprises a lubricant component, a fibrous filling material, and an elastic material; and the durometer hardness of the surface layer is A30/S to A70/S.

2. The semiconductive belt of claim 1, wherein the elastic material is a thermosetting elastomer.

3. The semiconductive belt of claim 1, wherein the resin comprises a polyimide resin.

4. The semiconductive belt of claim 1, wherein the thickness of the surface layer is 60 to 90% of the total belt thickness.

5. The semiconductive belt of claim 1, wherein the thickness of the substrate is 10 to 40% of the total belt thickness.

6. The semiconductive belt of claim 1, wherein the total thickness of the semiconductive belt is 0.05 to 0.6 mm.

7. The semiconductive belt of claim 1, wherein the semiconductive belt is used for an image forming apparatus.

8. An image forming apparatus comprising an image carrier, means for forming a toner image on the image carrier, means for primary transferring the toner image, means for secondary transferring the primary transferred toner image onto a recording medium, and a semiconductive belt, the semiconductive belt comprising a substrate and a surface layer, wherein:

the substrate comprises a resin;

the Young's modulus of the substrate is 1000 to 8000 MPa;

the surface layer comprises a lubricant component, a fibrous filling material, and an elastic material; and the durometer hardness of the surface layer is A30/S to A70/S.

9. The image forming apparatus of claim 8, wherein the elastic material is a thermosetting elastomer.

10. The image forming apparatus of claim 8, wherein the resin comprises a polyimide resin.

11. The image forming apparatus of claim 8, wherein the thickness of the surface layer is 60 to 90% of the total belt thickness.

12. The image forming apparatus of claim 8, wherein the thickness of the substrate is 10 to 40% of the total belt thickness.

13. The image forming apparatus of claim 8, wherein the total thickness of the semiconductive belt is 0.05 to 0.6 mm.

14. The image forming apparatus of claim 8, wherein the semiconductive belt is used as an intermediate transfer belt and/or a paper transport belt.

* * * * *